United States Patent [19]

Marforio

[11] 4,037,547

[45] July 26, 1977

[54] CLAMSHELL GUIDE TO APPLY ANNULAR ELASTIC BANDS ON CLOTHES

[75] Inventor: Nerino Marforio, Milan, Italy

[73] Assignee: Rockwell-Rimoldi S.p.A., Milan, Italy

[21] Appl. No.: 533,501

[22] Filed: Dec. 17, 1974

[30] Foreign Application Priority Data

Dec. 27, 1973 Italy ..... 32289/73

[51] Int. Cl.[2] ..... D05B 23/00; D05B 35/06

[52] U.S. Cl. ..... 112/121.27; 112/143; 112/152

[58] Field of Search ..... 112/121.26, 121.27, 112/152, 153, 136, 141, 143

[56] References Cited

U.S. PATENT DOCUMENTS

| | | | |
|---|---|---|---|
| 1,443,702 | 1/1923 | De Voe | 112/141 |
| 1,497,853 | 6/1924 | Hughes | 112/152 X |
| 2,313,261 | 3/1943 | Podgorny | 112/152 |
| 3,752,100 | 8/1973 | Sharp | 112/143 |

*Primary Examiner*—H. Hampton Hunter

[57] ABSTRACT

A guide for guiding elastic bands in a sewing machine for attachment to garments having a pair of opposed elements mounted on pivotable support members individual thereto. The combination of the internal surfaces of the opposed elements define a shaped channel for folding and maintaining the bands in the desired configuration for and during attachment to a garment. A control device is operatively connected to the opposed elements to permit selective movement of the latter in opposite directions. The elements can be moved between positions of contiguous relation, which serves to guide the bands and a spaced apart inclined position that serves to complete the final stages of each sewing operation and to facilitate insertion of a new band for the next sewing operation.

1 Claim, 6 Drawing Figures

Fig. 2
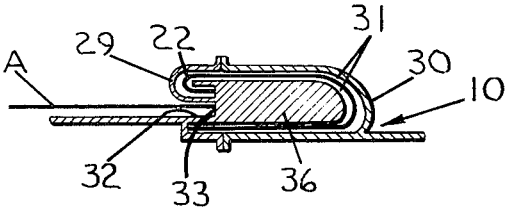
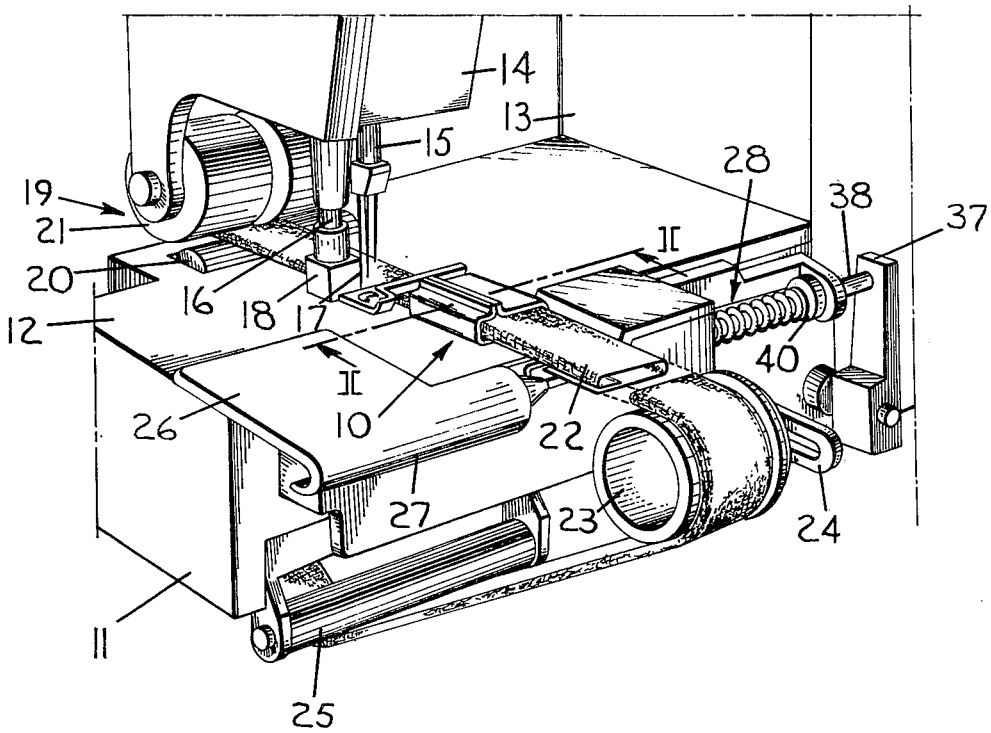
Fig. 1

FIG. 3
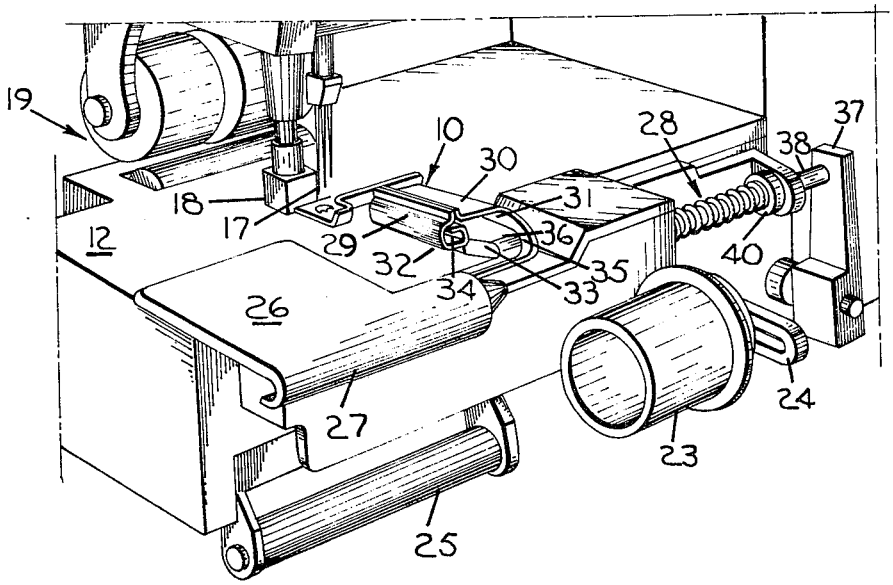
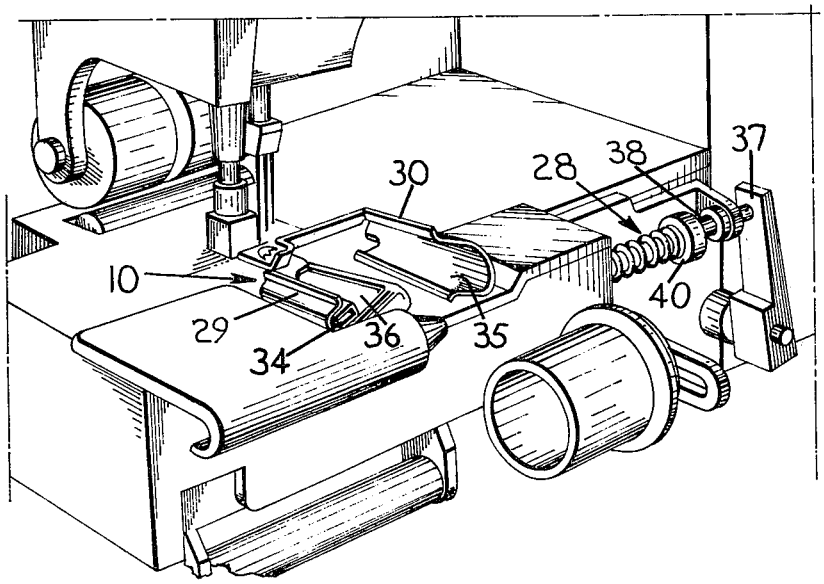
FIG. 4

CLAMSHELL GUIDE TO APPLY ANNULAR ELASTIC BANDS ON CLOTHES

BACKGROUND OF THE INVENTION

The present invention relates to an openable guide for sewing machines for attaching circular elastic bands or rings to garments. The guide includes a folding means consisting of two opposed elements which are separatable from one another and which are operatively interconnected. One of these elements is connected to a control means which is biased toward a position in which the two elements are disposed in contiguous relation whereby their inner surfaces form a shaped channel within which an elastic ring forming the band is caused to slide. The control means is actuated in opposition to a biasing means and is effective in separating the two elements for the purpose of completing the sewing operation of one band and to facilitate the insertion of another elastic ring to be sewn onto the next workpiece.

In the manufacture of certain types of garments, more particularly, those having an elastic waist band, it is common knowledge to sew a closed elastic ring onto a garment which has been folded along its edges to form a belt with an internal cavity which, if necessary can be used to incorporate an additional piece of elastic. The operations of folding and attaching the belt to the garment are effected simultaneously be opposed folding guides that are selectively separable so as to permit insertion of elastic ring between the open elements of the guide and to complete the final portion of each sewing operation prior to removing the sewn garment from the machine.

It is necessary for the guides intended for this type of work to be separable because the elastic rings as such possess neither a beginning nor an end and it is therefore impossible to insert them in the guide in the conventional manner and the two edges of the elastic ring must be inserted within the two elements forming the shaped channel of the folding device along a section of corresponding length to the guide per se. As mentioned above, guides which are formed to define opposed channels that are located in an accessible position are known but they have certain limitations considered to be undesireable.

With certain types of conventional guides only one of the component elements is movable with respect to the other which remains fixed in the zone in which the elastic ring is slidable during the stitching operation. As a result, the available space between the two elements is limited making it difficult to insert a ring to be sewn which must be arranged therein in accordance with its width. The stationary element which is not movable from its fixed position obstructs the feed movement which the sewing machine operator performs with one hand during the final stages of the sewing operation. In other types of known guides the stationary element is formed by two members in such a way that the upper portion which forms a part of the channel in which the elastic ring slides, can be raised by tilting it outwardly. A counterbalanced handle is provided for tilting this upper portion of the stationary element.

The presence of a handle projecting from the upper part of the guide and the face that this portion of the guide is manually displaceable is considered to be a desireable feature. However, even with this feature it is not possible to overcome the limited space created by the size of the fixed portion which is fixed in the zone through which the elastic ring is caused to advance. With another conventional form of guide both of the opposed elements of the guide are horizontally movable with respect to one another, one part moving in one direction and the other in the opposite direction.

However, this form of guide also has its disadvantages due to the fact that the width of the passage cannot be increased so as to simplify the passage to feed the workpiece by the operator and at the same time minimize the height of the unit formed by the two elements of the guide.

There is no possibility of increasing the mutual displacement of these elements due to the fact that their movements are linear. If mechanisms were designed to provide additional displacement such mechanisms would require an excessively large lever system.

The object of the present invention is to obviate the above disadvantages by providing maximum freedom in the zone in which the guide according to the invention is operative and also to ensure that when the guide is open, the half channels provided in each of the elements forming the guide are located in the most advantageous position for receiving the edges of the elastic ring.

The technical problem to be solved in achieving this object is that of providing a guide of the aforementioned type in which the two opposed elements in addition to being movable with respect to one another for the purpose of inserting the elastic ring are also capable of reducing the height of the guide in the zone located forwardly of the sewing machine's presser foot.

SUMMARY OF THE INVENTION

The guide according to the invention is provided with a pair of opposed folding elements mounted on support members individually supported for pivotal movement with the axes thereof being disposed parallel to the direction of advancement of the workpiece. The elements are simultaneously moveable in opposite directions to one another about their respective horizontal axis by a guide control means. When separated one from the other these elements are disposed in an inclined position which is lower than the position of said elements when they are in contact or their so-called closed position. The open or inclined position facilitates insertion of the edges of the elastic rings in the folding channels of these elements.

The most important feature provided by the present invention is that which is derived from the arched movement effected by the two folding elements forming the guide as they are separated one from the other.

When the support members are rotated slightly, they are displaced largely horizontally relative to the folding elements carried thereon.

As a result of the aforementioned rotation, the folding elements are not only moved into a lower position through rotation of the support members but the two half channels forming a part thereof which are adapted to receive the sides of the elastic ring are also inclined.

This feature substantially improves the task of inserting the edges of the elastic ring which are guided by the operator during the preliminary operations, and the ring assumes an arched shape over its entire width with its edges acquiring the same inclination as the half channels into which they are guided.

Other objects, features and advantages of the present invention will be made apparent in the following detailed description thereof provided with reference to the accompanying drawings, in which:

BRIEF DESCRIPTION OF THE DRAWINGS

FIG. 1 is a perspective view of a portion of a sewing machine showing a guide according to the invention applied thereto.

FIG. 2 is a sectional view of the guide taken along line 11—11 in FIG. 1.

FIGS. 3 and 4 are views similar to FIG. 1 showing the guide in both its closed and open positions.

DESCRIPTION OF THE PREFERRED EMBODIMENT

Figure 5:
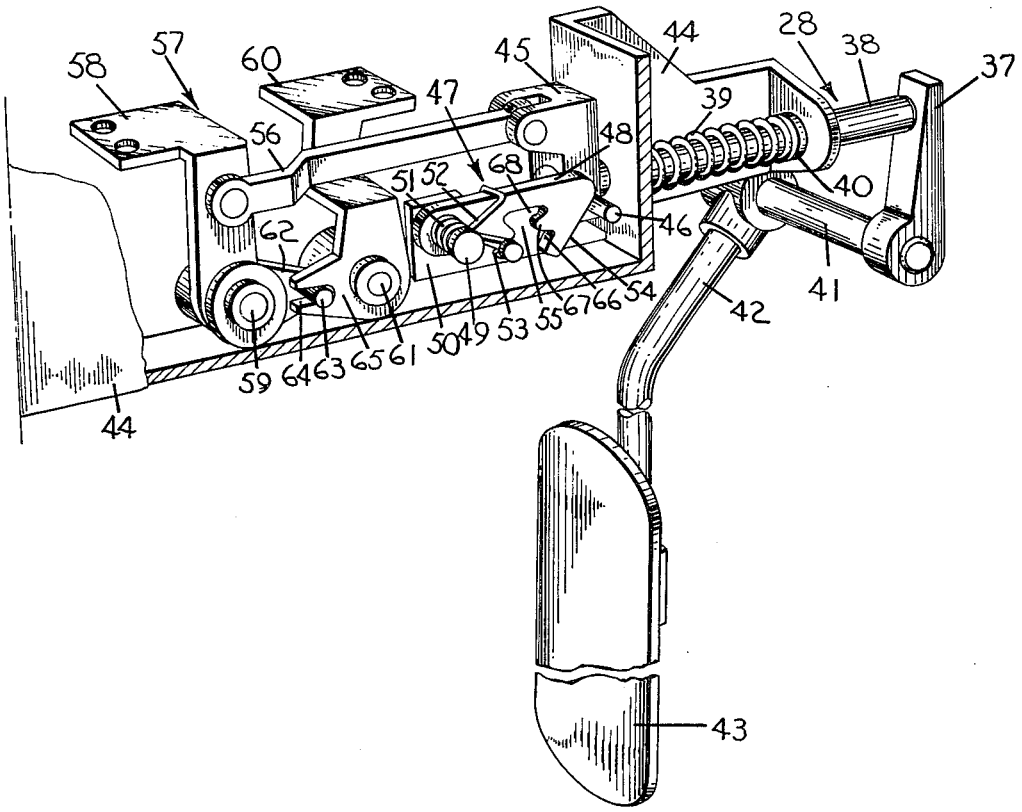
FIG. 5 is a perspective view of the pivotable support members for the guide showing a manually operable control means for actuating the support members.

Referring now to FIG. 1 the guide according to the invention is identified generally by numeral 10 and is mounted on a sewing machine having a base 11 the upper surface of which defines a workpiece support surface 12. An upright support 13 extends upwardly from the base to support a bracket arm (not shown) that terminates in a known form of head 14. A conventional needle bar 15 and a presser bar 16 are slidably mounted in the head 14, and extend downwardly therefrom. The needle bar 15 supports a number of needles 17 which are operatively associated with the conventional lower sewing elements (not shown) with which they cooperate to form stitches. The presser bar 16 has a presser foot 18 assembled thereon which cooperates with the conventional feed element (not shown) that is adapted to advance the workpiece during stitch formation.

The sewing machine is also provided with an additional rear feed means 19 which is intended for use when sewing elastic materials. An elastic ring 22 folded to form a belt for attachment to garments such as underpants and shorts extends between rollers 20 and 21 of the rear feed means 19.

The sewing machine also includes an upper tension roller 23 which is adjustably mounted on a slotted arm 24 which permits this roller to be selectively located at different distances from the base 11 so necessary adjustment can be made to accommodate different size elastic rings.

Additionally the sewing machine is provided with a tension roller 25 which is disposed in the lower part of the base 11 and serves to complete the path for the elastic ring.

The tension rollers serve to stretch the elastic ring 22 so that it can be sewn onto the garment in the fully elongated state. The garment itself is also stretched so that when the stitching operation has been completed and the workpiece finished, it will be elastically extensible thereby eliminating the possibility of tears developing at the seams.

Due to the fact that the belt or band for the garments is formed as a closed ring and which accordingly does not have an end or starting point, the guide 10 which is used to fold the ring along its edges to produce a belt, is adapted to be opened to permit insertion of said edges into the shaped internal channel of said guide which provides the ring with the desired fold.

The use of a guide which can be selectively opened is also necessary for finishing the sewing operation when the belt has nearly completed its rotation about the base of the machine and the starting point of the seam is approaching the mouth of the guide. As the sewn belt cannot slide through the shaped channel, the guide must be opened so as to allow the belt to slide outside of the guide until the final portion of the sewing operation has been completed.

The guide 10 is located on the workpiece support surface 12 forwardly of the presser foot 18 and to permit the garment, to which the belt 22 is being attached, to slide freely. A plate 26 having a curved leading edge 27 is provided immediately adjacent to said guide.

Additionally the guide 10 is provided with a control means 28 that is selectively operable to open the guide and hold it open during the initial and final sewing operations.

Referring now to FIGS. 2 and 3, the guide 10 includes two opposed elements 29 and 30 the internal surfaces of which define a shaped channel 31 which forms the shape of the cross-section of the elastic ring 22 to be attached to a garment A. The shaped channel 31 is formed by the combination of the internal surfaces of both the elements 29 and 30 with each of the latter defining a half channel within which the edges of the elastic ring 22 are inserted during the initial sewing stage when the elements 29 and 30 are in their open position. To permit correct positioning of the ring 22 on the garment, the lower part of the lefthand element 29 is provided with a passage 32 defined by a vertical wall 33 (FIG. 2) against which the garment A is caused to slide during the sewing operation.

When an elastic ring 22 for forming the belt or band is to be inserted in the guide 10, the latter is opened by moving the elements 29 and 30 apart from one another as shown in FIG. 4, thereby breaking the continuity of the shaped channel 31 and rendering the two half channels 34 and 35 readily accessible. The half channel 35 is formed by the combination of the righthand element 30 and the central portion 36, that is an integral part of the lefthand element 29, and which is positioned within said element 30 when the guide is closed. The guide 10 is opened by moving an arm 37 of the control means 28 to the left as viewed in FIG. 5 which effects axial movement of an actuating rod 38 which, in turn compresses a coil spring 39 by means of a ring 40 fixed on the rod 38.

The coil spring 39 is provided to return the elements 29 and 30 to the closed position corresponding to the rest position of the guide when the force exerted on the control means 28 has been terminated. Referring now to FIG. 5 the control means 28 also includes a transversal shaft 41 that is operatively connected to a downwardly extending rod 42. This rod 42 supports a plate member 43 which the operator actuates with her knee in order to open and close the guide 10.

The rod 38 is supported for axial movement in aligned apertures provided in a support member 44 and has a connector 45 fixed on one end that includes a laterally extending pin 46 which is adapted to lock said rod 38, upon full movement to the left, in that position corresponding to the open position of the guide. The retaining means is identified by numeral 47 and includes a latch member 48 which is pivotally mounted on a pin 49 which is fixed in and extends from a bracket 50 assembled in the support member 44.

A spring 51 is mounted on the pin 49 with one of its arms 52 being diposed so as to apply a clockwise biasing force on the latch member 48. The other arm of spring 51 is identified by numeral 53 and is fixed in a conventional manner to the bracket 50.

The latch member 48 is provided on that end adjacent the pin 46 with an inclined face 54 on which said pin 46 is adapted to slide whenever the rod 38 is moved towards the left. This movement causes upward pivotal movement of the latch member 48 causing the pin 46 to move beyond the inclined face 54 and to enter into a central opening 55 provided in said latch member 48 which is formed intermediate the ends of the latter. The opening 55 serves to permit the latch member 48 to pivot back to its initial position under the influence of spring 51 and to engage the pin 46 in a manner so as to prevent rod 38 from effecting its return movement towards the right.

One end of a connecting rod 56 is pivotally connected to a support means 57 of the guide 10 and the opposite end is pivotably mounted on the connector 45 by means of connecting rod 56. The axial movements of the rod 38 are transmitted to the support means 57 in a manner to cause pivotal movement of the latter.

More specifically the connecting rod 56 is connected to a first support 58 which is pivotably mounted in a substantially vertical position on a horizontal pin 59 that is attached to the support member 44 and extends therefrom parallel to the direction in which the workpiece is advanced A second support 60 is also disposed in a substantially vertical position and is pivotably mounted on a horizontal pin 61 which extends parallel with and is spaced apart from pin 59. Like pin 59 pin 61 is also attached to the support member 44.

The movements of the first support 58 are transmitted to the second support 60 by means of the transmission device consisting of an arm 62 integrally formed on said first support which includes a laterally extending pin 63 operatively disposed in a groove or bifurcation 64 provided in an integrally formed arm 65 of said second support 60. It can easily be seen that any pivotal movement of support 58 on pin 59 is transmitted to support 60 causing the latter to pivot in the opposite direction of said support 60. With element 29 being mounted on support 58 and element 30 of the guide 10 being mounted on the support 60, the opening and closing of the guide 10 can be selectively controlled.

When the pin 46 is caused to enter the central opening 55 after the rod 38 has been moved to the left, said pin 46 becomes located in the space identified by numeral 66 thus preventing the return of rod 38 to its initial position.

With an additional movement toward the left on the part of the rod 38 the pin 46 is caused to move beyond a projecting portion 67 of the latch member 48 and to a position of alignment with a groove 68 provided behind the projecting portion 67. The base of the groove 68 is inclined with the deeper portion disposed on the left-hand side of the opening 55 and the shallower portion of the righthand side. When the pin 46 becomes aligned with and enters this groove, it moves the latch member 48 outwardly so as to displace it from its normal position. This movement causes pin 46 to be disengaged from the latch member 48 and the rod 38 and then move to the right to its initial position under the influence of the coil spring 39. The movement of the rod 38 towards the right causes elements 29 and 30 to pivot toward each other so as to close the guide 10.

Figure 6:
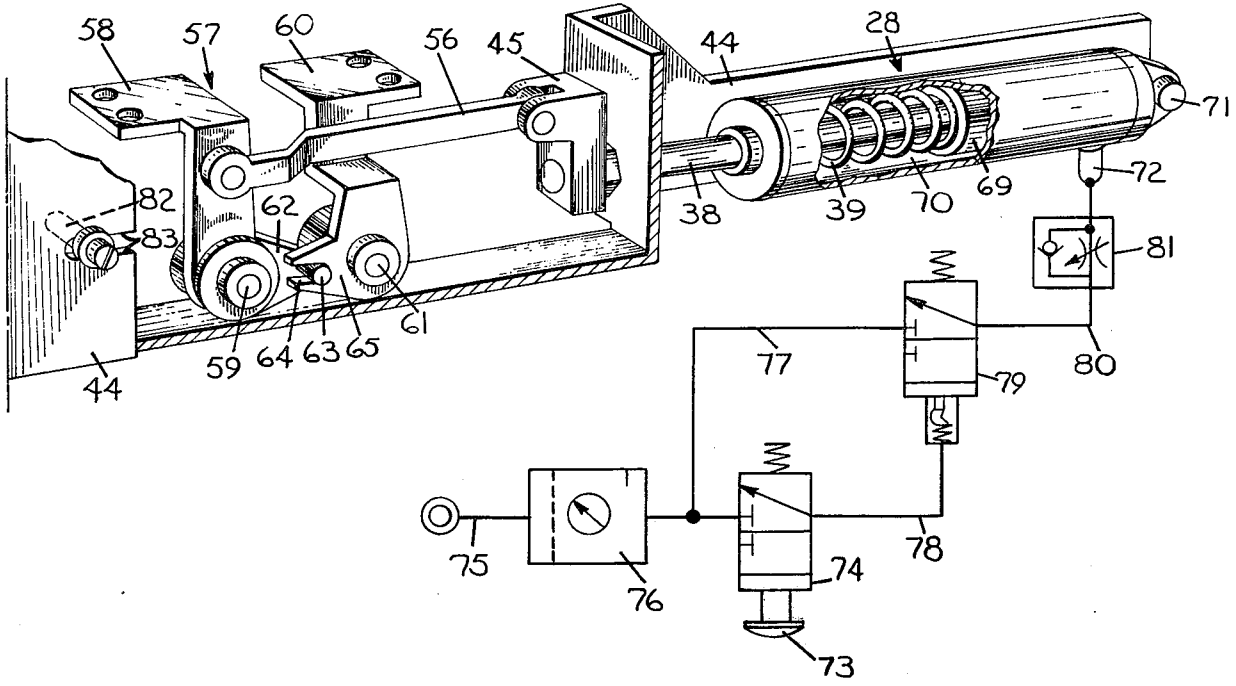
FIG. 6 is a view similar to FIG. 5 but showing a pneumatic control means for actuating the support members.

The control means can also be pneumatically actuated such as by a plunger 69 slidably mounted in a conventional cylinder 70 which is pivotally mounted on the support member 44 by means of a pin 71 (FIG. 6).

In FIG. 6 the rod 38 is shown forming the stem of the plunger 69 and the coil spring 39 disposed so as to urge said rod 38 toward its rest position. The coil spring 39 is disposed within the cylinder 70 intermediate its end wall and the plunger 69 such that when the latter is displaced by the compressed air entering the cylinder through a conduit 72 it compresses said coil spring in the same manner as the ring 40. Additionally the coil spring 39 is effective in moving the plunger 69 and rod 38 to the right of their rest position when the force of the compressed air is terminated.

The open position of the guide 10 is obtained by continuously directing compressed air into the cylinder 70.

By exerting slight pressure on a knob 73 of a control valve 74, the compressed air which is supplied through the supply line 75 via a conventional group filter-manometer-lubricator unit 76 which is located in the conduit 77, is able to pass into the control conduit 78 subsequent to temporary switching of the control valve 74, thus activating a flip-flop valve 79. The flip-flop valve 79 is located in the circuit supplying the cylinder 79 for it can maintain the position determined for it by means of the control valve 74 for an indefinite period of time without having to keep the knob 73 depressed. When open, the flip-flop valve 79 allows compressed air contained in the conduit 77 to pass into a conduit 80 that is connected to a stroke regulator 81, which is in turn connected to the conduit 72 leading to the cylinder 70.

The stroke regulator 81 is adapted to permit compressed air to move unrestricted to the cylinder 70 so as to obtain rapid opening of the guide 10 and to regulate the rate at which the compressed air contained in the cylinder is discharged after the supply has been interrupted by the application of pressure on the knob 73 which effects switching of the valve 79.

Consequently, by regulating the return rate of the plunger 69, it is possible to control the closing rate of the guide as desired.

When pneumatic control means are utilized, it is possible to vary the displacement rates of elements 29 and 30, thus providing the advantage of being able to accelerate the operation of removing the finished workpiece from the sewing machine. This is made possible because the guide can be opened rapidly and the operation of inserting another elastic ring is facilitated by the fact that the guide can be closed more slowly, thus enabling the operator to arrange the ring in the shaped channel without interrupting the closing movement of the guide, which is effected automatically by a servo control means.

A further advantage provided by the pneumatic control means is that of controlling the distance the plunger is permitted to move toward the left so as to regulate the width of the opening of the guide 10. To achieve this, a stop 82 (FIG. 6) is provided which is selectively positionable in a slot 83 provided in the support member 44 adjacent the first support 58. The groove 83 extends parallel to the direction of displacement of the rod 38 and depending on the distance of the stop 82 from the support 58, the movements towards the left of the latter, and consequently the movements towards the right of the second support 60 can be controlled as desired.

Although the present invention has been described in connection with a preferred embodiment and a modification thereof, it is to be understood that other modifications and variations may be resorted to without departing from the spirit and scope of the invention as those skilled in the art will readily understand. Such modifications and variations are considered to be within the purview and scope of the invention and the appended claims.

What is claimed is:

1. An openable guide for guiding circular elastic bands to the sewing instrumentalities of a sewing machine for attachment as waist bands onto garments, said guide comprising:

a. individual support members (58, 60) independently mounted for pivotal movement on the sewing machine;

b. a pair of opposed elements (29, 30) attached to said support members (58, 60) respectively having cooperating internal surfaces defining a shaped channel (31) through which the elastic bands are guided;

c. control means (28) operatively connected to a first one said support members (58) for selectively pivoting the latter between positions of close proximity with and a lower inclined location spaced from the others of said support members (60); and d. means (62, 63, 64) interconnecting said first one of said support members (58) with the other of said support members (60) for effecting simultaneous pivotal movement of the latter with and in a direction opposite to said first support member (58) during selective actuation of said control means (28);

e. said means for effecting simultaneous pivotal movement of said support member 60 including:

1. a bifurcated arm (65) extending from and forming an integral part of said support member 60; and 2. an arm 62 forming an integral part of said support member (58) having a laterally extending pin (63) disposed within the bifurcation of said arm (65).

* * * * *